United States Patent [19]

Mullaly

[11] Patent Number: 4,955,094

[45] Date of Patent: Sep. 11, 1990

[54] HEAD-BOARD RECLINER USING THE ONLY ONE HINGE

[76] Inventor: Peirce J. Mullaly, 28871 Hogan, Sun City, Calif. 92381

[21] Appl. No.: 282,605

[22] Filed: Dec. 12, 1988

[51] Int. Cl.[5] ..... A47C 20/00

[52] U.S. Cl. ..... 5/433; 5/53.2; 297/354; 297/14

[58] Field of Search ..... 5/53 R, 53 B, 53 C, 5/53 D, 72, 71, 74 R, 433, 432, 59 R; 297/354, 355, 361

[56] References Cited

U.S. PATENT DOCUMENTS

| | | | |
|---|---|---|---|
| 2,724,127 | 2/1952 | Trivas . | |
| 2,844,829 | 7/1958 | Levy | 5/432 |
| 2,946,066 | 7/1960 | Hopkins | 5/59 R |
| 3,482,271 | 12/1969 | Enright | 5/53 B |
| 3,683,430 | 8/1972 | Bradley | 5/433 |
| 3,774,247 | 11/1973 | Bradley | 5/53 B |
| 4,015,298 | 2/1975 | Scott . | |
| 4,628,552 | 10/1984 | Magistretti . | |
| 4,646,372 | 3/1987 | Hanson | 5/53 B |
| 4,754,507 | 7/1988 | Edge | 5/433 |

FOREIGN PATENT DOCUMENTS

| | | | |
|---|---|---|---|
| 215097 | 10/1960 | Austria | 297/354 |
| 1265897 | 3/1972 | United Kingdom | 5/433 |

*Primary Examiner*—Gary L. Smith
*Assistant Examiner*—Flemming Saether

[57] ABSTRACT

A Head-board Recliner presenting the same visual aspect as the standard head-board, differing in the appearance only in that there are two large panels, the recliners, and one or more smaller panels, which fill out the horizontal width of the head-board. The recliners pull out a specific distance, clear of the bed, and lock to a rigid position, providing support for the upper body, while a person reads, watches television, or lounges. Continuous hinges, which are attached to the back of each recliner, top and bottom, and then to a mounting board, provide the support and the articulation. The mounting board is secured to a wall or other type support. The lower continuous hinge is inter-locked to a sliding pad. This sliding pad limits the action of the hinges, stabilizes them a desired point, providing a friction free operation in opening or closing the recliner. The sliding pad also provides a storing place for the sliding feature of the lower continuous hinge.

4 Claims, 3 Drawing Sheets

HEAD-BOARD RECLINER USING THE ONLY ONE HINGE

FIELD OF THE INVENTION

This invention relates to the providing of a recliner feature for a headboard. Particularly, it is concerned with the supporting mechanism for such a recliner.

PRIOR ART

A variety of backrests have been developed which serve the dual purpose of a vertical decorative headboard for a bed, and a reclining place which provides angular support for the torso of a person reading or lounging in such environment.

The concern for adjustability in these backrests, in prior art, seems to have created a common problem. The simpler and less expensive units while suited for domestic use have not combined sufficient ruggedization to provide for maintainability in commercial lodgings.

SUMMARY

The present invention overcomes this problem by a unitary hinge assembly which permits the headboard recliner to be securely set into one specific angular position by simply pulling out the bottom of the recliner. Utilizing the extended hinge pin as part of the lifting or closing lever provides a simple, easy, durable, means of closing the unit. Little accessability to the working parts are offered when the unit is in open position: only the lifting levers are exposed when the unit is closed.

This headboard recliner is equipped with heavy duty continuous hinges, allowing for a substantial number of screws, or such anchoring devices to secure them to the various parts. The recliners are supported top and bottom by these hinges and are held in a stable position during the opening or closing of the unit. The slide-pad, with the slotted guides on either side, let the unit perform in a low friction environment, and make for a smooth, easy operation in closing as well as opening. The unit is designed for considerable rough usage.

DESCRIPTION OF THE DRAWINGS

Because of the volatility in manufacturing processes and materials, the general intent is to take advantage of whatever process aids in the utility and appearance of the unit.

There are three major parts to this invention: (1) the recliners, (2) the hinges, (3) the mounting board. There is also the center divider. The features and functions of the headboard recliner are more easily illustrated by the drawings.

DESCRIPTION OF THE PREFERRED EMBODIMENT(S)

Figure 1:
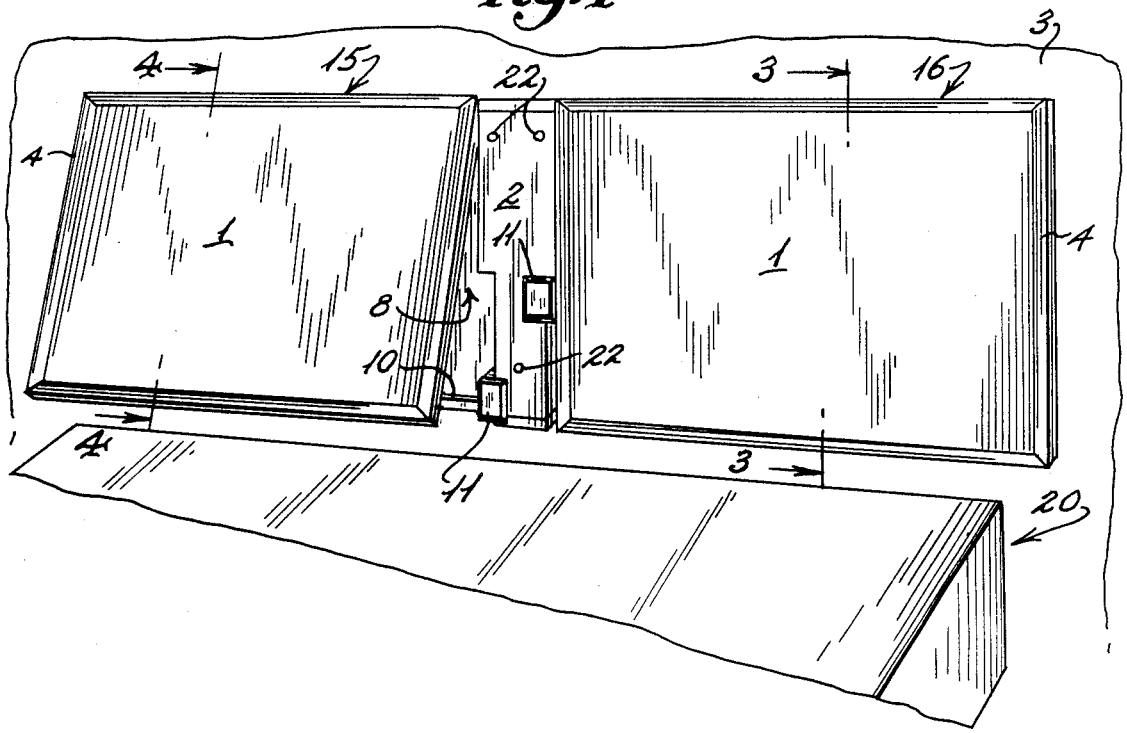
FIG. 1 is a perspective view of the headboard recliner.
Figure 3:
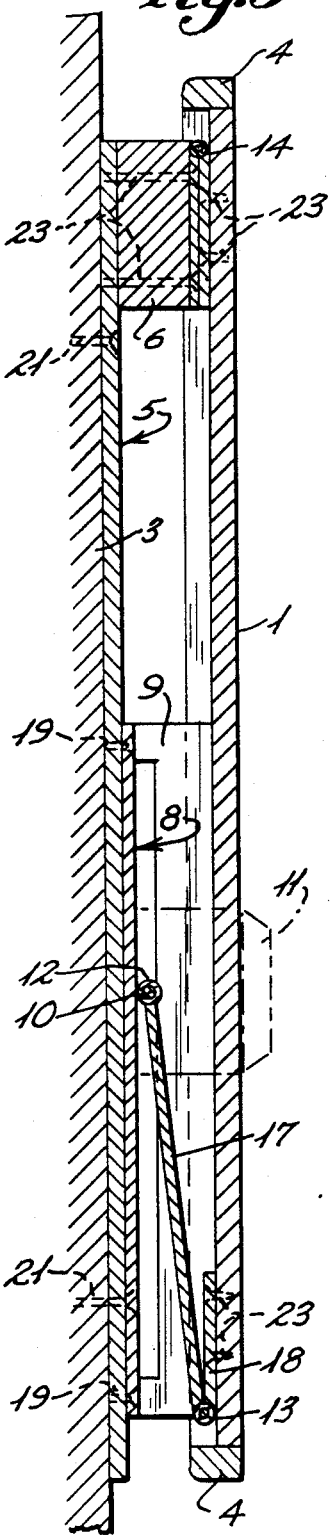
FIG. 3 is a sectional view along line 3—3 of FIG. 1.

FIGS. 1 and 3 illustrate features that are central to the general appearance of the headboard recliner. Two recliners, means (15) and (16), are separated by a center divider (2), each having like parts and dimensions. The numeral (3) indicates the wall or other structure supporting the headboard recliner unit. Concealing hinges when the recliners (1) are in closed position is accomplished through the means of a molding (4), skirting the outer edge of the recliners, with such molding creating a cavity back on said recliners (1). Closing or lifting levers (11) are in the center divider (2). The bed, or like facility, is designated as (20).

Figure 4:
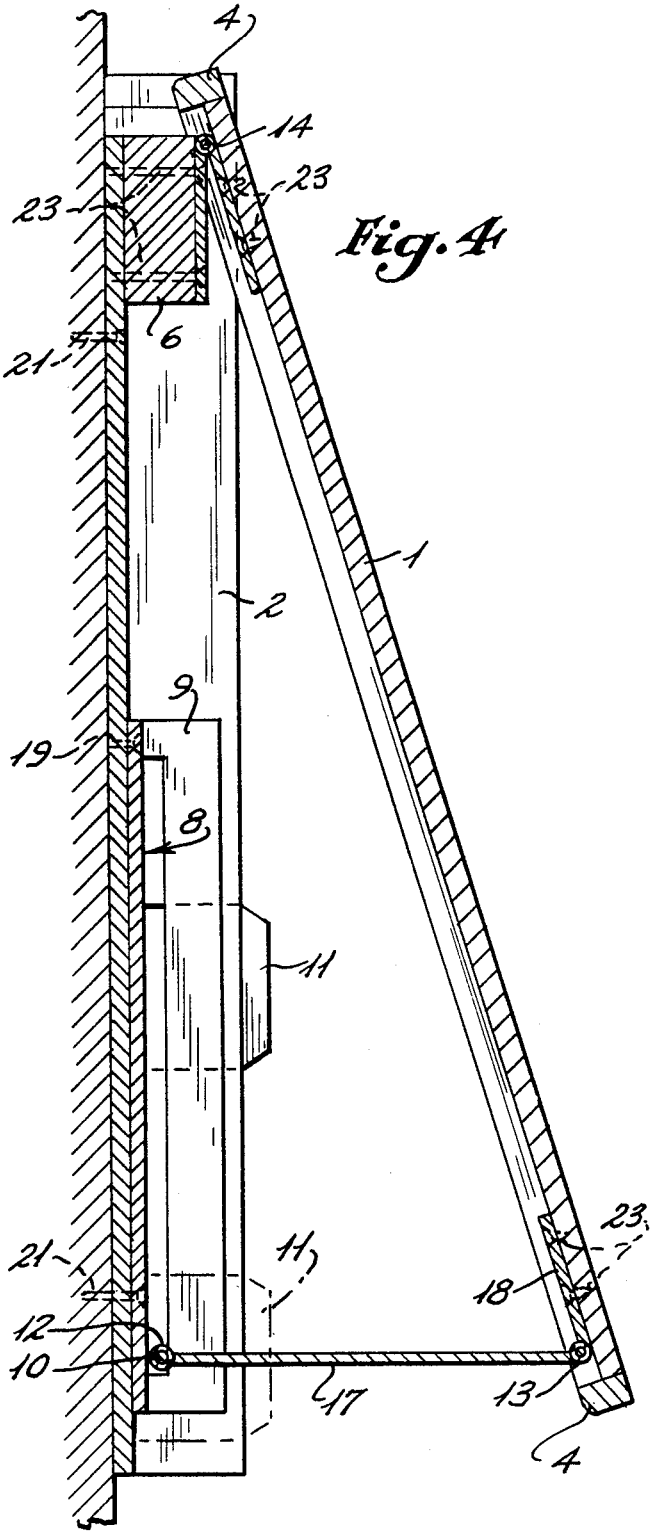
FIG. 4 is a sectional view along line 4—4 of FIG. 1.

FIGS. 3 and 4 show the mounting board (5) as being integral to the headboard unit, using the top hinge (14) to hang the recliner (1) to the mounting board (5), by means of a mounting pad (6). There is also a leveling pad (not shown) behind the center divider (2), to bring the divider to a level plane with the recliners. The slide pad (8) is secured to the mounting board (5) by means of screws (19). The recliners (1) with the connecting hinges (13) and (14) are attached to the mounting board (5), and excepting for the center divider (2), the entire unit is secured as one piece to the wall (3), or such structure, by means of anchoring devices (21). Extended hinge pins (10) with the lifting levers (11) attached thereto, are inserted into hinge (12). The center divider (2) is installed by means of screws (22), completing the installation, and leaving the parts inacessable.

Figure 2:
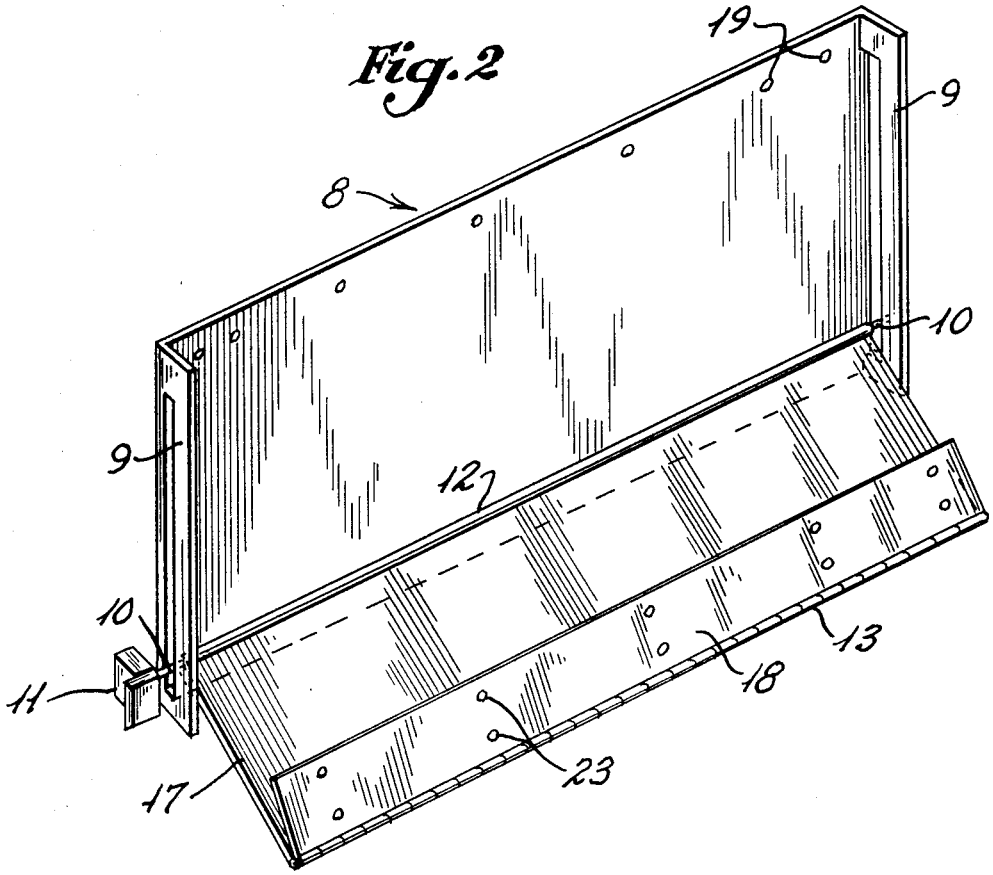
FIG. 2 is a perspective view of the sliding pad, the extended hinge pin, and the lower continuous hinge with the wide leg interconnected with the slide pad, as they would interact when the recliner is in open or reclining position.

A distinguishing feature of this headboard recliner is a lower hinge of the recliners (1), as detailed in FIG. 2, and FIGS. 3 and 4. The slide pad (8), with the slotted guides (9), is connected to the lower section of the mounting board (5) by screws (19). Interconnecting the lower section of the mounting board (5) by means of the extended hinge pin (10), is a wide leg (17) of lower hinge (13) which extend the length of hinge (12). A narrow leg (18) of hinge (13) is secured by screws (23) to the lower section of the recliners (1). When the recliner (1) is in closed position, as in FIG. 3, the hinge (12) is near the top of the slide pad (8), and the wide leg (17) is in nearly vertical position. As the recliner (1) is pulled out at the bottom, the wide leg (17) drops down to a substantially horizontal position, as in FIG. 4. In closing the recliner (1), the lifting lever (11) is pushed up, directly raising hinge (12), and the leading edge of the wide leg (17), changing weight distribution of the recliner (1), and forcing the recliner to close of it's own weight. The lifting lever (11) is shown in FIGS. 1 and 2, The recliner (1) is detailed in closed position in FIG. 3.

Referring to FIGS. 3 and 4, the top hinge (14) is attached by screws (23) to the hinge pad (6) at the top of mounting board (5), and to the back top of the recliners (1). The hinge pad (6) is used to hold the recliner (1) out the same distance from the mounting board (5) as the slotted guides (9). As illustrated in FIG. 3, the sliding pad (8) is a storage place for the wide leg (17) and the hinge (12) when the recliner (1) is in the closed position, thus minimizing the width of the entire unit from the wall (3).

What I claim is:

1. A headboard recliner for use with a bed, said recliner including;

a mounting board having upper and lower ends and with means for securing to a supporting structure:

an adjustable recliner means having upper and lower ends;

a first hinge means interconnecting the upper end of said mounting board and the upper end of said adjustable recliner means;

a leg means attached to the lower end of said recliner means by a second hinge at one end;

a sliding pad with a slotted guide means mounted to the lower end of said mounting board and receiving the other end of leg means;

said leg means being adjustably moveable within said slotted guide means to thereby allow pivoting of said recliner relative to said mounting board from first substantially vertical position wherein the leg is at a upper end of said slot, to a second inclined position wherein the leg is at the lower end of said slot.

2. The headboard recliner of claim 1 wherein the first and second hinge means extend substantially along the entire length of the recliner means.

3. The headboard recliner of claim 1 further including a molding, skirting the outer edge of said recliner for concealing the hinges when said recliner is in the substantially vertical position.

4. The headboard recliner of claim 1 further including a first and second recliner means spaced apart on said mounting board by a center divider.

* * * * *